US010726750B2

(12) United States Patent
Yanagibashi et al.

(10) Patent No.: US 10,726,750 B2
(45) Date of Patent: Jul. 28, 2020

(54) SIGNAL PROCESSING APPARATUS AND SIGNAL PROCESSING METHOD

(71) Applicant: CANON KABUSHIKI KAISHA, Tokyo (JP)

(72) Inventors: Ken Yanagibashi, Yokohama (JP); Hirofumi Urabe, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 12 days.

(21) Appl. No.: 16/027,747

(22) Filed: Jul. 5, 2018

(65) Prior Publication Data

US 2019/0051226 A1 Feb. 14, 2019

(30) Foreign Application Priority Data

Aug. 8, 2017 (JP) ..... 2017-153361

(51) Int. Cl.
*G09G 3/00* (2006.01)

(52) U.S. Cl.
CPC ..... *G09G 3/00* (2013.01); *G09G 2340/0407* (2013.01); *G09G 2340/0435* (2013.01); *G09G 2370/042* (2013.01); *G09G 2370/10* (2013.01)

(58) Field of Classification Search
None
See application file for complete search history.

(56) References Cited

U.S. PATENT DOCUMENTS 7,818,675 B2 10/2010 Maruyama
8,756,629 B2 6/2014 Mito
2009/0285273 A1* 11/2009 Mizutani ..... H04N 21/23418 375/220

FOREIGN PATENT DOCUMENTS

JP 2009-283994 12/2009

* cited by examiner

*Primary Examiner* — Samira Monshi
(74) *Attorney, Agent, or Firm* — Venable LLP

(57) ABSTRACT

A signal processing apparatus according to the present invention, includes: a signal type determining unit configured to determine a signal type of an SDI signal that is inputted; an acquiring unit configured to acquire payload information from the SDI signal; and a payload information determining unit configured to determine payload information that is used for display setting of the SDI signal, based on a state of acquiring the payload information by the acquiring unit, wherein the payload information determining unit determines whether previously determined payload information is continuously used as the payload information used for the display setting, based on the state of acquiring the payload information by the acquiring unit and the signal type determined by the signal type determining unit.

13 Claims, 8 Drawing Sheets

FIG. 4

| PAYLOAD INFORMATION TABLE | | |
|---|---|---|
| SIGNAL TYPE | | PAYLOAD INFORMATION |
| TRANSMISSION TYPE | TRANSMISSION STANDARD | |
| PROGRESSIVE TYPE | 3G/6G/12G-SDI | 89 C9 00 01 |
| PROGRESSIVE TYPE | SD/HD-SDI | 85 C7 20 01 |
| INTERLACE TYPE | 3G/6G/12G-SDI | 89 07 02 02 |
| INTERLACE TYPE | SD/HD-SDI | 85 05 20 01 |

FIG. 8A

| SDI SIGNAL TRANSMISSION STANDARD | PAYLOAD INFORMATION ADDED TO SDI SIGNAL | | | | | | |
|---|---|---|---|---|---|---|---|
| 3G-SDI | NONE | → | NONE | → | NONE | → | NONE |

FIG. 8B

| SDI SIGNAL TRANSMISSION STANDARD | PAYLOAD INFORMATION ADDED TO SDI SIGNAL | | | | | | |
|---|---|---|---|---|---|---|---|
| 3G-SDI | CORRECT (3G-SDI) | → | NONE | → | CORRECT (3G-SDI) | → | NONE |

FIG. 8C

| SDI SIGNAL TRANSMISSION STANDARD | PAYLOAD INFORMATION ADDED TO SDI SIGNAL | | | | | | |
|---|---|---|---|---|---|---|---|
| 6G-SDI | CORRECT (6G-SDI) | → | INCORRECT (UNKNOWN) | → | CORRECT (6G-SDI) | → | INCORRECT (UNKNOWN) |

SIGNAL PROCESSING APPARATUS AND SIGNAL PROCESSING METHOD

BACKGROUND OF THE INVENTION

Field of the Invention

The present invention relates to a signal processing apparatus and a signal processing method.

Description of the Related Art

Serial digital interface (SDI) signals are standardized under the Society of Motion Picture and Television Engineers (SMPTE) standards that concern imaging techniques. Among the standards on SDI signals, SMPTE ST 352 specifies the standard on payload information (video payload identification code) added to SDI signals. The payload information includes information on the SDI signals, including the transmission type (e.g. progressive type, interlace type, progressive segment frame (PsF) type), and the sampling structure. The display apparatus performs the display setting of the SDI signals based on the payload information.

However an output apparatus that outputs the SDI signals does not always output correct payload information. For example, there are output apparatuses that do not add the payload information (FIG. 8A), and output apparatuses that repeats adding the payload information and not adding the payload information (FIG. 8B). For example, some output apparatuses alternately repeat adding correct payload information, and adding unknown (incorrect) payload information (FIG. 8C).

Therefore when the display apparatus performs display setting based on the payload information outputted from an output apparatus, an incorrect display setting (e.g. display setting unintended by user) may be performed, or an incorrect update of the display setting may be repeated.

With the foregoing in view, a technique to add predetermined payload information to an SDI signal, if payload information is not added to the SDI signal, was proposed in the past (Japanese Patent Application Publication No. 2009-283994). Another technique which was proposed in the past is that when a state where correct payload information is added to the SDI signal is switched to another state, the correct payload information before switching is continuously used as the payload information for display setting (transfer of payload information).

SUMMARY OF THE INVENTION

However, in the case of the prior art disclosed in Japanese Patent Application Publication No. 2009-283994, when an SDI signal is outputted from an output apparatus which alternately repeats adding the payload information and not adding the payload information, payload information that is different from the payload information originally added to the SDI signal may be added to the SDI signal. In this case, the payload information originally added to the SDI signal and another payload information added by the above mentioned prior art disclosed in Japanese Patent Application Publication No. 2009-283994 are alternately repeated to the SDI signal. Further, payload information is not added to an SDI signal outputted from an output apparatus which alternately repeats adding the correct payload information and adding the incorrect payload information, and in this case, the incorrect payload information is not corrected. Hence even if the prior art disclosed in Japanese Patent Application Publication No. 2009-283994 is used, the incorrect display setting may be repeatedly updated.

In the case of using the above mentioned prior art in which the payload information is transferred, an incorrect display setting may be performed. For example, when the switching apparatus switches an SDI signal, to which correct payload information is added, is switched to an SDI signal to which correct payload information is not added, an incorrect display setting may be performed for the display setting of the SDI signal after switching. In concrete terms, when a progressive type SDI signal is switched to an interlace type SDI signal, the progressive type payload information is continuously used, and the PsF type display setting is performed for the interlace type SDI signal.

The present invention in its first aspect provides a signal processing apparatus, comprising:

a signal type determining unit configured to determine a signal type of an SDI signal that is inputted;

an acquiring unit configured to acquire payload information from the SDI signal; and a payload information determining unit configured to determine payload information that is used for display setting of the SDI signal, based on a state of acquiring the payload information by the acquiring unit, wherein the payload information determining unit determines whether previously determined payload information is continuously used as the payload information used for the display setting, based on the state of acquiring the payload information by the acquiring unit and the signal type determined by the signal type determining unit.

The present invention in its second aspect provides a non-transitory computer readable medium that stores a program, wherein the program causes a computer to execute:

a signal type determining step of determining a signal type of an SDI signal that is inputted;

an acquiring step of acquiring payload information from the SDI signal; and a payload information determining step of determining payload information that is used for display setting of the SDI signal, based on a state of acquiring the payload information in the acquiring step, and in the payload information determining step, it is determined that whether previously determined payload information is continuously used as the payload information used for the display setting, based on the state of acquiring the payload information in the acquiring step and the signal type determined in the signal type determining step.

The present invention in its third aspect provides a signal processing method, comprising:

a signal type determining step of determining a signal type of an SDI signal that is inputted;

an acquiring step of acquiring payload information from the SDI signal; and a payload information determining step of determining payload information that is used for display setting of the SDI signal, based on a state of acquiring the payload information in the acquiring step, wherein in the payload information determining step, it is determined that whether previously determined payload information is continuously used as the payload information used for the display setting, based on the state of acquiring the payload information in the acquiring step and the signal type determined in the signal type determining step.

Further features of the present invention will become apparent from the following description of exemplary embodiments with reference to the attached drawings.

BRIEF DESCRIPTION OF THE DRAWINGS

FIG. 4 is an example of a table stored in a payload information storing unit according to Example 2;

FIGS. 8A to 8C show each example of an SDI signal which is inputted to each apparatus according to Examples 1 to 3.

DESCRIPTION OF THE EMBODIMENTS

Example 1

Example 1 of the present invention will be described.

Example 1 described here is a signal processing apparatus configured to determine whether payload information determined previously is continuously used as payload information for display setting, based on the payload information acquiring state and the determined signal type.

A case of a display apparatus which includes a signal processing apparatus will be described, but the signal processing apparatus may be separate from the display apparatus.

Figure 1:
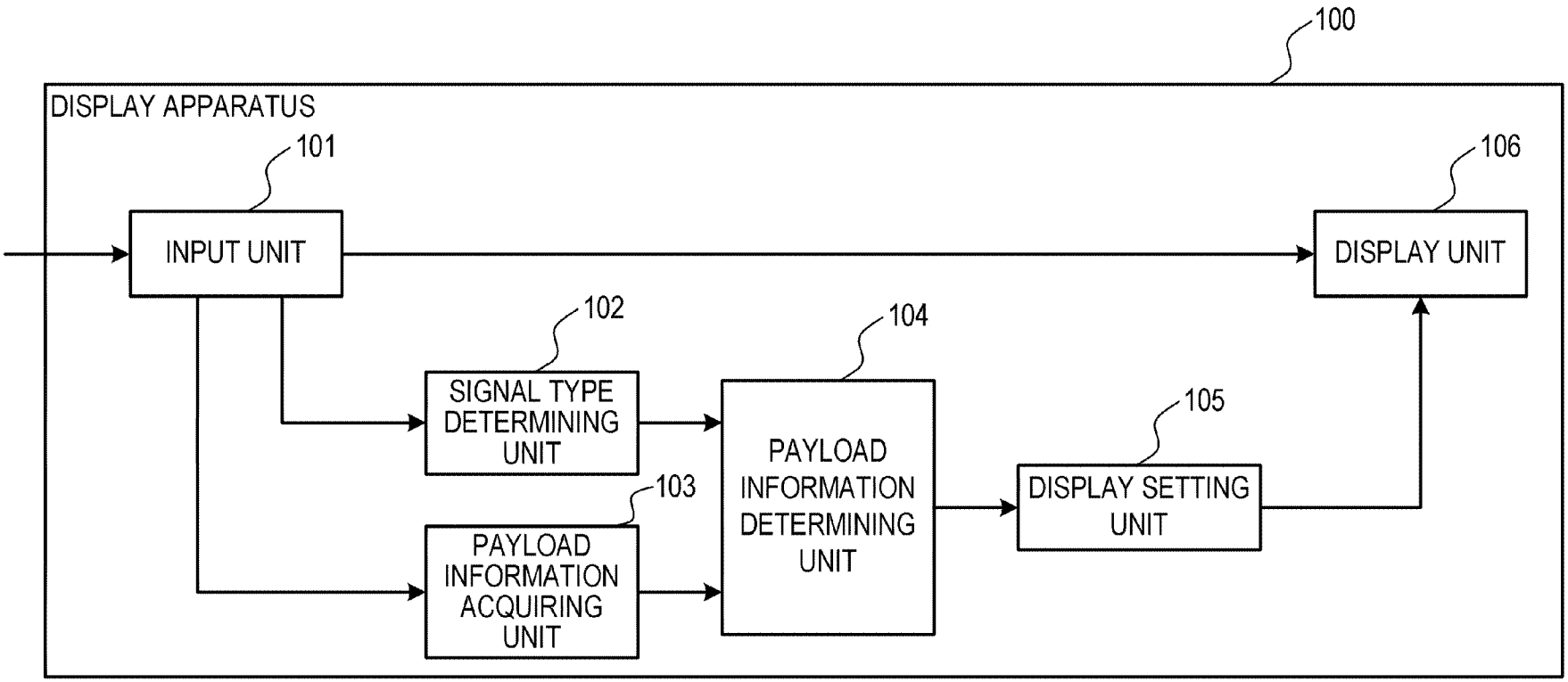
FIG. 1 is a block diagram depicting a configuration example of a display apparatus according to Example 1.

FIG. 1 is a block diagram depicting a configuration example of a display apparatus 100 according to Example 1. The display apparatus 100 includes an input unit 101, a signal type determining unit 102, a payload information acquiring unit 103, a payload information determining unit 104, a display setting unit 105 and a display unit 106.

The input unit 101 acquires (receives) a serial digital interface (SDI) signal, and outputs the acquired SDI signal to the signal type determining unit 102, the payload information acquiring unit 103, and the display unit 106. The standard of the SDI signal is specified by the Society of Motion Picture and Television Engineers (SMPTE) standard concerning imaging techniques. The input unit 101 may acquire the SDI signal from outside the display apparatus 100 by cable, or may acquire the SDI signal from outside the display apparatus 100 wirelessly.

The signal type determining unit 102 sequentially determines the signal type of each SDI signal acquired by the input unit 101, and sequentially outputs the determined signal type to the payload information determining unit 104. For example, the signal type determining unit 102 determines the signal type of the SDI signal by analyzing the SDI signal. In Example 1, the transmission type (e.g. progressive type, interlace type) of the SDI signal and the transmission standard (e.g. SD-SDI, HD-SDI, 3G-SDI, 6G-SDI, 12G-SDI) of the SDI signal are determined as the signal type.

The payload information acquiring unit 103 sequentially acquires the payload information from the SDI signal acquired by the input unit 101, and sequentially outputs the acquired payload information to the payload information determining unit 104. The payload information includes, for example, signal format sampling structure/pixel depth information and frame/field rate (Hz) information. The signal format sample structure/pixel depth information is, for example "4:2:2 $Y'C_B'C_R'$ 10-bit", "4:4:4 $Y'C_B'C_R$ 10-bit", "4:4:4 RGB 10-bit" and the like. The frame/field rate (Hz) information is, for example, "1080p:24", "1080PsF:24", "1080i:60" and the like. The sign "i" indicates the interlace type, "p" indicates the progressive type, and "PsF" indicates the progressive segmented frame (PsF) type. The PsF type is an interlace type in which each frame of an original signal of the progressive type is divided into two fields (odd field, even field), which represent equivalent images. The input unit 101 may acquire the SDI signal by the SDI wireless transmission of "video over IP", which is specified by the SMPTE 2022 standard. The payload information may be information in the ancillary data acquired by the SDI wireless transmission of the video over IP.

The payload information determining unit 104 sequentially determines the payload information that is used for the display setting of the SDI signal acquired by the input unit 101, and sequentially outputs the determined payload information to the display setting unit 105. Here, in some cases, the input unit 101 may acquire an SDI signal to which the payload information is not added (FIG. 8A). Further, the input unit 101 may acquire an SDI signal in which a state of the payload information being added and a state of the payload information not being added are alternately repeated (FIG. 8B). Furthermore, the input unit 101 may acquire an SDI signal in which a state of correct payload information being added and a state of unknown (incorrect) payload information being added are alternately repeated (FIG. 8C). Therefore the payload information acquiring unit 103 does not always acquire correct payload information (payload information corresponding to this apparatus (display apparatus 100: signal processing apparatus)). Hence the payload information determining unit 104 sequentially determines the payload information that is used for the display setting, based on the payload information acquiring state by the payload information acquiring unit 103. The payload information determining unit 104 has a memory (not illustrated) where a table, in which correct payload information (payload information corresponding to this apparatus) is written in advance, is stored. The payload information determining unit 104 determines whether the payload information acquired by the payload information acquiring unit 103 is correct payload information by determining whether the payload information acquired by the payload information acquiring unit 103 matches with the predetermined payload information which is written in the table.

In concrete terms, if the correct payload information is acquired by the payload information acquiring unit 103, the payload information determining unit 104 determines the acquired payload information as the payload information to be used for display setting. If the correct payload information is not acquired, the payload information determining unit 104 determines whether the previously determined payload information is continuously used as the payload information used for display setting, based on the signal type determined by the signal type determining unit 102.

The display setting unit 105 performs display setting for the display unit 106 using the payload information determined by the payload information determining unit 104. In Example 1, the display setting unit 105 incorporates the transmission type and the sampling structure indicated in the payload information into the display setting. The information incorporated into the display setting is not limited to the transmission type and the sampling structure. The display setting specified by the user may be performed.

The display unit 106 displays an image based on the SDI signals acquired by the input unit 101, according to the display setting performed by the display setting unit 105.

Figure 2:
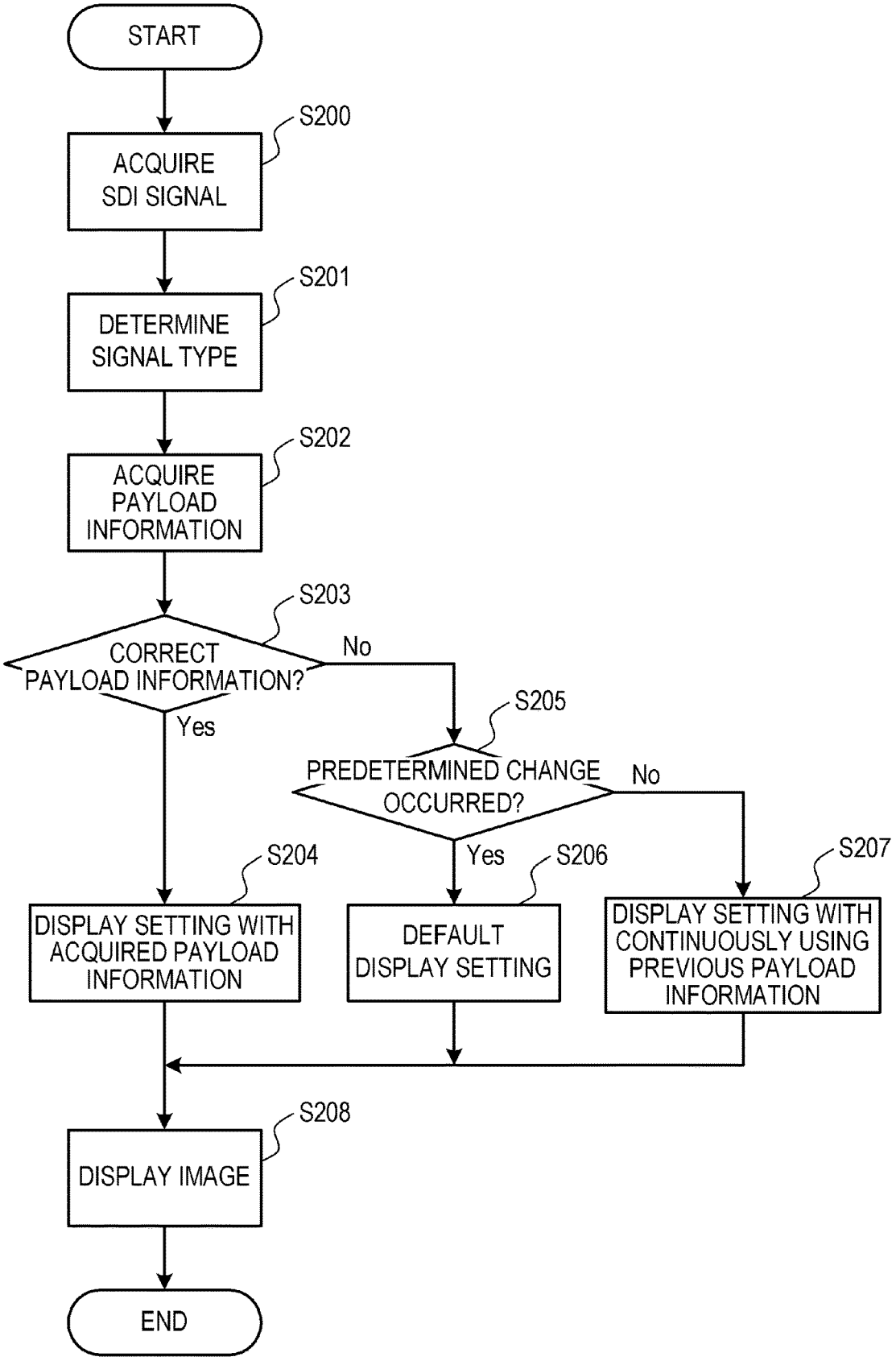
FIG. 2 is a flow chart depicting a processing flow example of the display apparatus according to Example 1.

FIG. 2 is a flow chart depicting a processing flow example of the display apparatus 100. The display apparatus 100 sequentially performs the processing flow in FIG. 2. For example, if the transmission type of an SDI signal acquired by the input unit 101 is the interlace type, the display apparatus 100 performs the processing flow in FIG. 2 for each field of this SDI signal. And if the transmission type of an SDI signal acquired by the input unit 101 is the progressive type, the display apparatus 100 performs the processing flow in FIG. 2 for each frame of this SDI signal.

First in S200, the input unit 101 acquires the SDI signal (field or frame) from an external apparatus.

Then in S201, the signal type determining unit 102 analyzes the SDI signal acquired in S200, so as to determine the signal type of this SDI signal.

Then in S202, the payload information acquiring unit 103 acquires the payload information from the SDI signal acquired in S200.

Then in S203, the payload information determining unit 104 determines whether correct payload information (payload information corresponding to the display apparatus 100) was acquired in S202. For example, if payload information is acquired in S202, the payload information determining unit 104 determines whether this payload information is correct payload information by referring to this payload information. If payload information is not acquired in S202, the payload information determining unit 104 determines that correct payload information was not acquired. If it is determined that correct payload information was acquired (S203: YES), processing advances to S204, and if it is determined that correct payload information was not acquired (S203: NO), processing advances to S205.

In S204, the payload information determining unit 104 determines the payload information acquired in S202 as the payload information used for the display setting, and the display setting unit 105 performs the display setting for the display unit 106 using the payload information acquired in S202. Then processing advances to S208.

In S205, the payload information determining unit 104 determines whether a predetermined change occurred to the signal type determined by the signal type determining unit 102. The predetermined change is a change that does not allow the transfer of the previously determined payload information. If it is determined that the predetermined change occurred (S205: YES), processing advances to S206, and if it is determined that the predetermined change did not occur (S205: NO), processing advances to S207.

In Example 1, a plurality of transmission standards are classified into at least two transmission standard groups. In concrete terms, a plurality of transmission standards are classified into a transmission standard group that includes SD-SDI and HD-SDI which do not support 4K image resolution, and a transmission standard group that includes 3G-SDI, 6G-SDI and 12G-SDI which support 4K image resolution. Then the change of the determined transmission type and the change of the transmission standard group which includes the determined transmission standard are regarded as predetermined changes respectively. In other words, if the transmission type determined this time is different from the transmission type determined the last time, it is determined that a predetermined change occurred. Also if the transmission standard group that includes a transmission standard determined this time is different from the transmission standard group that includes the transmission standard determined the last time, it is determined that the predetermined change occurred. If the transmission type determined this time is the same as the transmission type determined the last time, and the transmission standard group that includes the transmission standard determined this time is the same as the transmission standard group that includes the transmission standard determined the last time, it is determined that the predetermined change did not occur.

In S206, the display setting unit 105 performs a predetermined display setting (default display setting) for the display unit 106. In concrete terms, the payload information determining unit 104 determines a predetermined payload information (default payload information) as a payload information used for the display setting. Using this default payload information, the display setting unit 105 performs display setting for the display unit 106. Then processing advances to S208.

The default payload information is preferably payload information which is often used for an SDI signal. For example, the default payload information includes signal format sampling structure/pixel depth information "4:4:4 RGB 10-bit" and frame/field rate (Hz) information "1080i: 60".

In S207, the payload information determining unit 104 continuously uses the previously determined payload information as the payload information used for the display setting, and the display setting unit 105 performs the display setting for the display unit 106 using this previously determined payload information. Then processing advances to S208.

In S208, the display unit 106 displays an image based on the SDI signal acquired in S200 according to the display setting performed by the display setting unit 105. In Example 1, the display unit 106 displays an image based on the SDI signal acquired in S200 according to the display setting in S204, S206 or S207.

As described above, according to Example 1, it is determined whether the previously determined payload information is continuously used as the payload information used for the display setting, based on the payload information acquiring state and the determined signal type. In concrete terms, if correct payload information is not acquired, it is determined whether the previously determined payload information is continuously used as the payload information used for the display setting, based on the determined signal type. Thereby the previously determined payload information can be transferred only in the case when this payload information is allowed to be transferred, and as a result, the transfer of the payload information can be appropriately performed.

For example, if an SDI signal, in which a state of a correct payload information being added and a state of a correct payload not being added are alternately repeated, is inputted, the correct payload information added to this SDI signal can be continuously used for the display setting. Even if the switching apparatus switched an SDI signal to which a correct payload information is added, to an SDI signal to which a correct payload information is not added, the correct payload information can be used for the display setting. For example, if a predetermined change did not occur to the signal type, the correct payload information added to the SDI signal before switching can be continuously used for the display setting. If a predetermined change occurred to the signal type, the payload information is not transferred, and the default payload information is used for the display setting.

The signal type is not limited to the transmission type and the transmission standard. For example, the image resolution frame rate of the SDI signal may be determined as the signal type. One signal type may be determined or a plurality of signal types may be determined. The predetermined change is not limited to the change of the transmission type or the change of the transmission standard group. The change of the transmission standard, the change of the image resolution, the change of the frame rate or the like may be determined as the predetermined change. The predetermined change may be a change of one signal type or a combination of a plurality of changes of a plurality of signal types. For example, instead of handling each of the change of the transmission type and the change of the transmission standard group as the predetermined change respectively, changes of both the transmission type and the transmission standard group may be handled as predetermined changes.

Example 2

Example 2 of the present invention will be described. According to a signal processing apparatus described in Example 2, the correspondence of the correct payload information and the signal type is stored, and when a predetermined changes occurs without acquiring correct payload information, the stored correct payload information is determined as the payload information used for the display setting. In the following, aspects (configuration and processing) different from Example 1 will be described in detail, and description on the aspects that is the same as Example 1 will be omitted.

Figure 3:
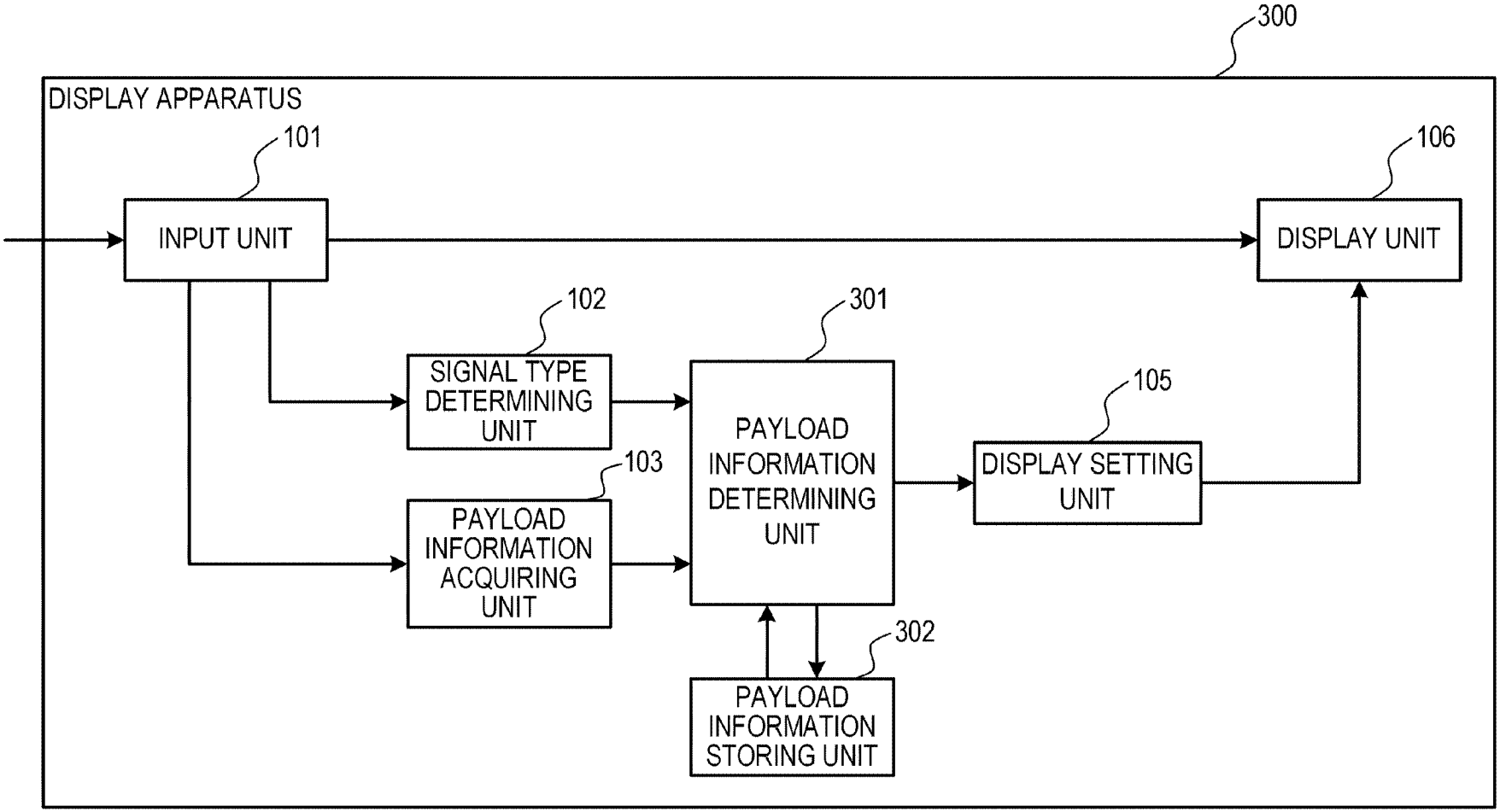
FIG. 3 is a block diagram depicting a configuration example of a display apparatus according to Example 2.

FIG. 3 is a block diagram depicting a configuration example of a display apparatus 300 according to Example 2. In FIG. 3, a functional unit that is the same as Example 1 (FIG. 1) is denoted with the same reference sign as Example 1.

A payload information determining unit 301 has functions that are the same as the payload information determining unit 104 of Example 1. Further, if correct payload information is acquired by the payload information acquiring unit 103, the payload information determining unit 301 records this correct payload information in a payload information storing unit 302 in association with the signal type determined by the signal type determining unit 102. If correct payload information is not acquired and a predetermined changes occurred, the payload information determining unit 301 determines payload information that is different from the default payload information as the payload information used for the display setting. In concrete terms, the payload information determining unit 301 reads the payload information, which is recorded in the payload information storing unit 302 in association with the signal type that is the same as the signal type determined by the signal type determining unit 102, from the payload information storing unit 302. Then the payload information determining unit 301 outputs the read payload information to the display setting unit 105 as the payload information used for the display setting. If the payload information storing unit 302 does not store the payload information in association with the signal type that is the same as the signal type determined by the signal type determining unit 102, the default payload information may be determined as the payload information used for the display setting.

As described above, the payload information determining unit 301 records correct payload information in the payload information storing unit 302 in association with the signal type. In other words, the payload information storing unit 302 stores the correspondence of correct payload information and the signal type as shown in the table in FIG. 4. The payload information storing unit 302 may be included in the display apparatus 300 (signal processing apparatus), or may be detachable from the display apparatus 300.

Figure 5:
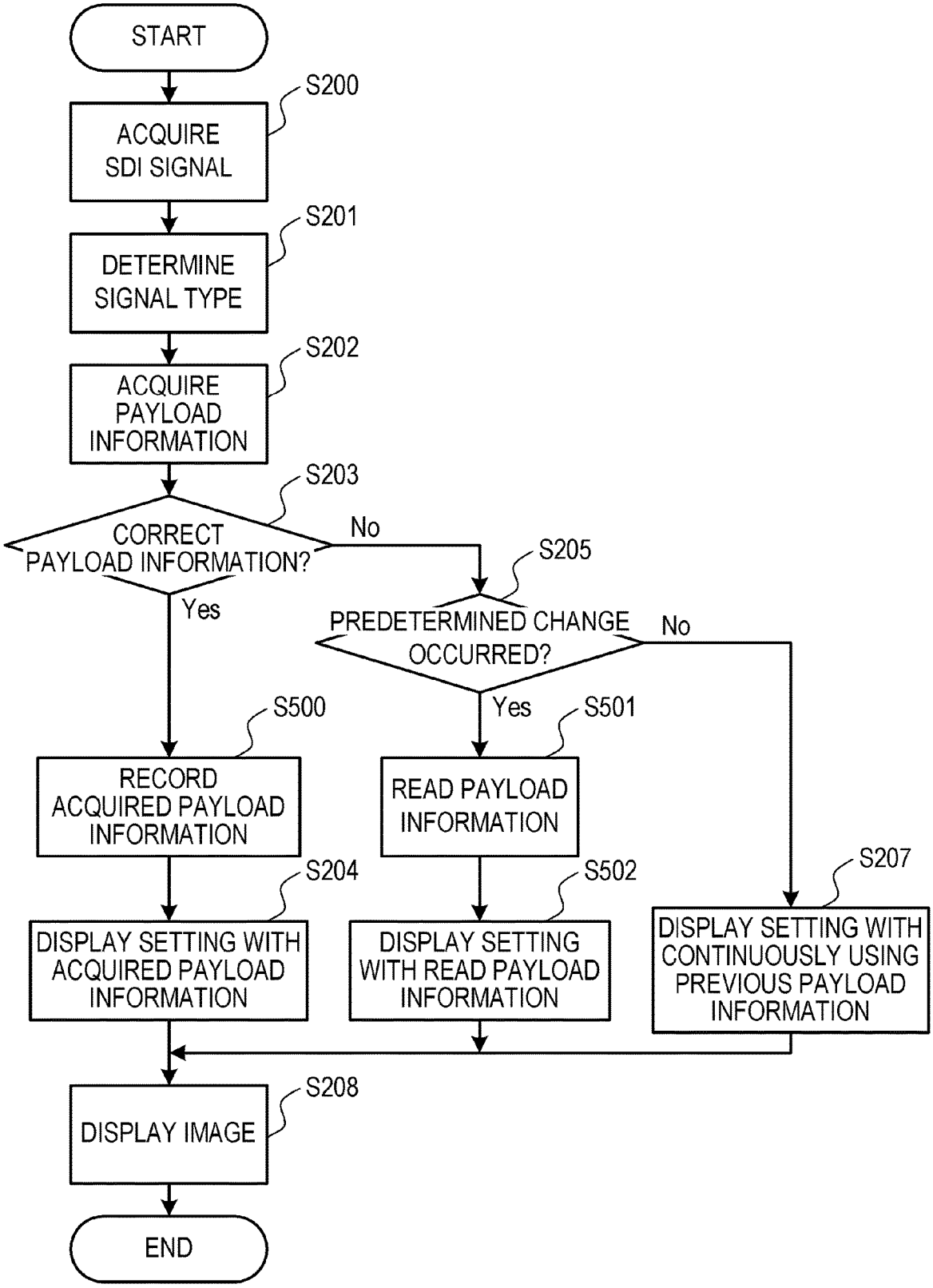
FIG. 5 is a flow chart depicting a processing flow example of the display apparatus according to Example 2.

FIG. 5 is a flow chart depicting a processing flow example of the display apparatus 300. The display apparatus 300 sequentially performs the processing flow in FIG. 5. In FIG. 5, processing that is the same as Example 1 (FIG. 3) is denoted with the same reference sign as Example 1.

In Example 2, if the payload information determining unit 301 determines that correct payload information was acquired (S203: YES), the processing operations in S500, S204 and S208 are performed. In S500, the payload information determining unit 301 records the payload information acquired in S202 in the payload information storing unit 302 in association with the signal type determined in S201. If the payload information determining unit 301 determines that correct payload information was not acquired (S203: NO), processing advances to S205, similarly to Example 1.

If the payload information determining unit 301 determines that a predetermined change occurred (S205: YES), the processing operations in S501, S502 and S208 are performed. If the payload information determining unit 301 determines that the predetermined change did not occur (S205: NO), the processing operations in S207 and S208 are performed, similarly to Example 1.

In S501, the payload information determining unit 301 reads the payload information, which is associated with the signal type that is the same as the signal type determined in S201, from the payload information storing unit 302. Then in S502, the display setting unit 105 performs the display setting for the display unit 106 using the payload information which was read in S501.

As described above, according to Example 2, if correct payload information is acquired, this correct payload information is recorded in the storing unit, in association with the determined signal type. If correct payload information was not acquired and a predetermined change occurred, the payload information recorded in the storing unit, in association with the signal type that is the same as the determined signal type, is determined as the payload information used for the display setting. Thereby the payload information, that is even more appropriate than Example 1, can be used for the display setting. In concrete terms, if the correct payload information was not acquired and the predetermined change occurred, payload information that is more appropriate than the default payload information can be used for the display setting.

Example 3

Example 3 of the present invention will be described. In Example 3, a signal processing apparatus in which determined payload information is added to the SDI signal will be described. In the following, aspects (configuration and processing) that are different from Example 1 will be described in detail, and description on the aspects that are the same as Example 1 will be omitted.

Figure 6:
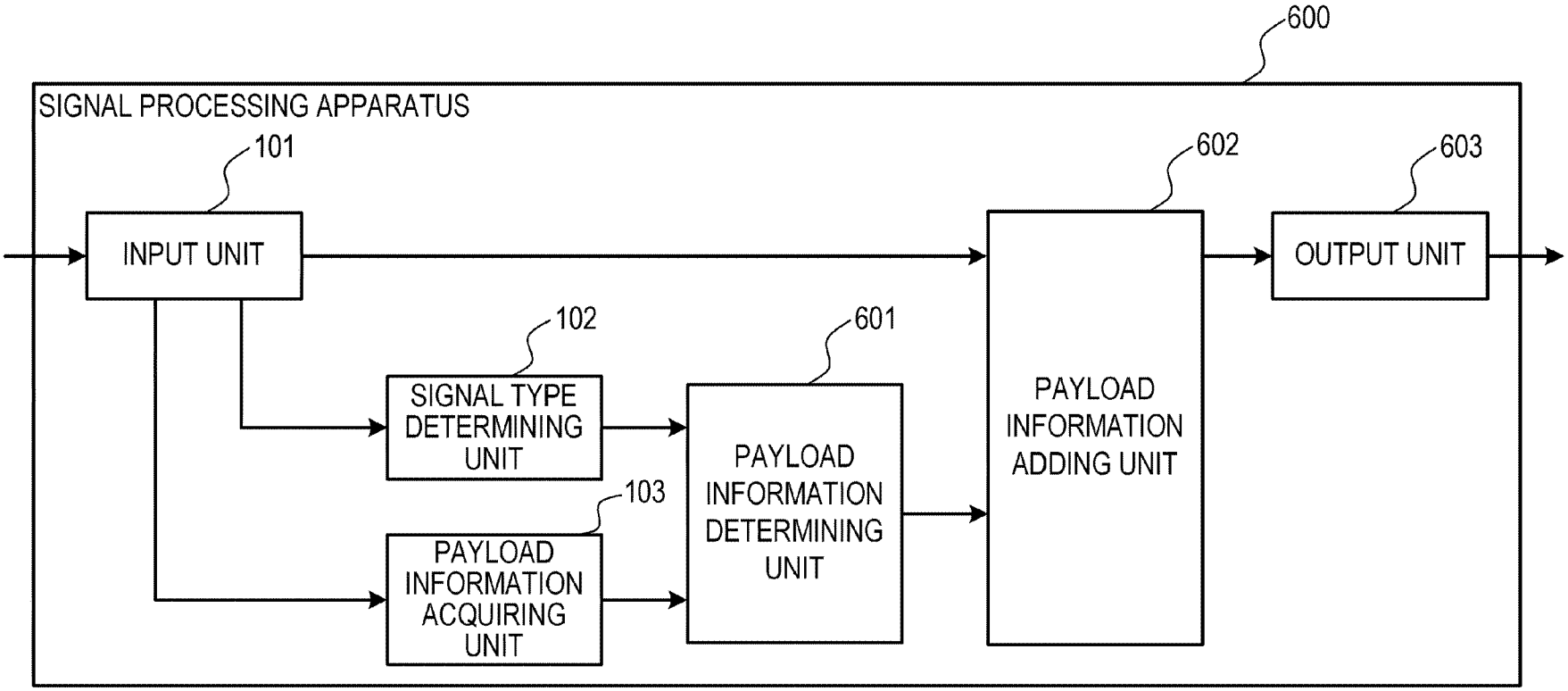
FIG. 6 is a block diagram depicting a configuration example of a signal processing apparatus according to Example 3.

FIG. 6 is a block diagram depicting a configuration example of a signal processing apparatus 600 according to Example 3. In FIG. 6, a functional unit that is the same as Example 1 (FIG. 1) is denoted with the same reference sign as Example 1.

A payload information determining unit 601 has the same functions as the payload information determining unit 104 in Example 1. Further, if correct payload information was not acquired by the payload information acquiring unit 103, a payload information adding unit 602 adds the payload information determined by the payload information determining unit 601 to the SDI signal acquired by the input unit 101.

In concrete terms, only if correct payload information was not acquired by the payload information acquiring unit 103, the payload information determining unit 601 outputs the payload information, which was determined as the payload information used for the display setting, to the payload information adding unit 602. Then if the payload information is outputted from the payload information determining unit 601, the payload information adding unit 602 adds this payload information to the SDI signal acquired by the input unit 101, and outputs the SDI signal after adding the payload information to the output unit 603. If the payload information is not outputted from the payload information determining unit 601, the payload information adding unit 602 directly outputs the SDI signal acquired by the input unit 101 to the output unit 603.

The output unit 603 outputs the SDI signal after performing the processing of the payload information adding unit 602, to an external apparatus via cable or wirelessly. In concrete terms, the output unit 603 outputs the SDI signal, which was outputted from the payload information adding unit 602, to the external apparatus.

Figure 7:
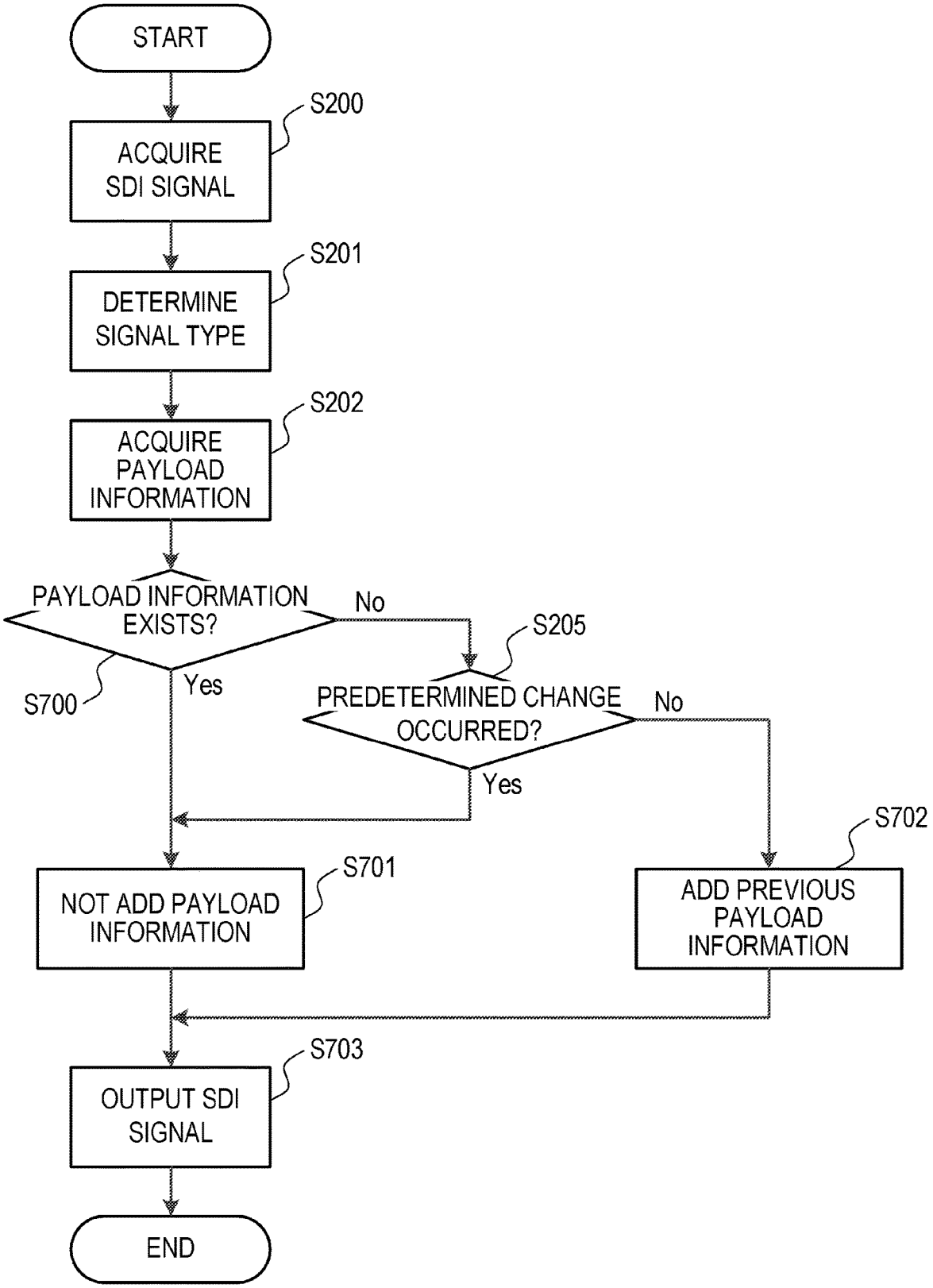
FIG. 7 is a flow chart depicting a processing flow example of the signal processing apparatus according to Example 3.

FIG. 7 is a flow chart depicting a processing flow example of the signal processing apparatus 600. The signal processing apparatus 600 sequentially performs the processing flow in FIG. 7. In FIG. 7, processing that is the same as Example 1 (FIG. 3) is denoted with the same reference sign as Example 1.

In Example 3, after S202, the payload information determining unit 601 determines in S700 whether the payload information was acquired in S202. If it is determined that the payload information was acquired (S700: YES), processing advances to S701. If it is determined that the payload information was not acquired (S700: NO), processing advances to S205. If the payload information determining unit 601 determines that a predetermined change occurred (S205: YES), processing advances to S701, and if the payload information determining unit 601 determines that the predetermined change did not occur (S205: NO), processing advances to S702.

In S701, the payload information adding unit 602 directly outputs the SDI signal acquired in S200 (not adding the payload information). In this case, if payload information is acquired in S202, for example, the payload information determining unit 601 determines the payload information acquired in S202 as the payload information used for the display setting. If the payload information is not acquired in S202, the payload information determining unit 601 omits the step of determining the payload information used for the display setting.

In S702, the payload information determining unit 601 determines the previously determined payload information as the payload information used for the display setting. Then the payload information adding unit 602 adds the previously determined payload information to the SDI signal acquired in S200, and outputs the SDI signal after adding the payload information.

After performing the processing in S701 or S702, processing advances to S703. In S703, the output unit 603 outputs the SDI signal, which was outputted from the payload information adding unit 602 in S701 or S702, to the external apparatus.

As described above, according to Example 3, if correct payload information is not acquired, it is determined whether the previously determined payload information is continuously used as the payload information used for the display setting, based on the determined signal type, similarly to Example 1. Thereby in Example 3 as well, the previously determined payload information can be transferred only in the case when this payload information is allowed to be transferred, and as a result, the transfer of the payload information can be appropriately performed. Further, if correct information is not acquired, the payload information determined as the payload information used for the display setting is added to the SDI signal, and the SDI signal after adding the payload information is outputted. Therefore appropriate display setting can be performed by using the SDI signal, outputted from the signal processing apparatus in Example 3, for display.

According to Example 3, the determined payload information is added to the SDI signal only when the payload information is not acquired, and a predetermined change did not occur. In other words, the payload information is not added, for example, when incorrect payload information is acquired, or when the predetermined change occurred. However, the payload information may be added even in the cases where the incorrect payload information is acquired, or when the predetermined change occurred. For example, when the predetermined payload information is not acquired and a predetermined change has occurred, the default payload information (Example 1) or the recorded payload information (Example 2) may be determined as the payload information used for the display setting, and may be added to the SDI signal. Further, when incorrect payload information was acquired and the predetermined change occurred, the default payload information or the recorded payload information may be determined as the payload information used for the display setting. Furthermore, when incorrect payload information was acquired and the predetermined change did not occur, previously determined payload information may be determined as the payload information used for the display setting. After the incorrect payload information is determined as the payload information used for the display setting, this payload information may be replaced with the above mentioned payload information. In Example 3, display setting may be performed in the same manner as Example 1 or 2.

Each functional unit in Examples 1 to 3 may be or may not be independent hardware. The functions of at least two functional units may be implemented by common hardware. Each of a plurality of functions of one functional unit may be implemented by independent hardware respectively. At least two functions of one functional unit may be implemented by common hardware. Each functional unit may or may not be implemented by hardware. For example, an apparatus may include a processor or a memory storing a control program. Thereby the functions of at least a part of the functional units of the apparatus may be implemented by the processor reading the control program from the memory and executing the control program.

Examples 1 to 3 are merely examples, and configuration acquired by appropriately modifying or changing the configurations of Examples 1 to 3 within the scope of the essence of the present invention are included in the present invention. Configurations acquired by appropriately combining the configurations of Examples 1 to 3 are also included in the present invention.

OTHER EMBODIMENTS

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-153361, filed on Aug. 8, 2017, which is hereby incorporated by reference herein in its entirety.

What is claimed is:

1. A signal processing apparatus, comprising:

a signal type determining unit configured to determine a signal type of an SDI (Serial Digital Interface) signal that is input to the signal processing apparatus;

an acquiring unit configured to acquire payload information from the SDI signal; and a payload information determining unit configured to determine payload information that is used for display setting of the SDI signal, based on a state of acquiring the payload information by the acquiring unit, wherein, in a case where predetermined payload information corresponding to this signal processing apparatus is not acquired by the acquiring unit, and a predetermined change has not occurred to the signal type determined by the signal type determining unit, the payload information determining unit continuously uses previously determined payload information as the payload information used for the display setting.

2. The signal processing apparatus according to claim 1, wherein the signal type includes at least a transmission type of the SDI signal, and the predetermined change is a change including at least a change of the transmission type.

3. The signal processing apparatus according to claim 1, wherein the signal type includes at least a transmission standard of the SDI signal, and the predetermined change is a change including at least a change of the transmission standard.

4. The signal processing apparatus according to claim 1, wherein the signal type includes at least a transmission standard of the SDI signal, a plurality of transmission standards are classified into at least two transmission standard groups, and the predetermined change is a change including at least a change of the transmission standard groups.

5. The signal processing apparatus according to claim 1, wherein the signal type includes at least an image resolution of the SDI signal, and the predetermined change is a change including at least a change of the image resolution.

6. The signal processing apparatus according to claim 1, wherein the signal type includes at least a frame rate of the SDI signal, and the predetermined change is a change including at least a change of the frame rate.

7. The signal processing apparatus according to claim 1, further comprising:

a display unit configured to display an image based on the SDI signal; and a setting unit configured to perform the display setting for the display unit by using the payload information determined by the payload information determining unit.

8. The signal processing apparatus according to claim 1, further comprising:

an adding unit configured to add the payload information determined by the payload information determining unit to the SDI signal in a case where the acquiring unit has not acquired predetermined payload information corresponding to this signal processing apparatus; and an outputting unit configured to output SDI signal after processing by the adding unit is performed.

9. The signal processing apparatus according to claim 8, wherein only in the case where the payload information is not acquired by the acquiring unit and the predetermined change has not occurred to the signal type determined by the signal type determining unit, the adding unit adds the payload information determined by the payload information determining unit to the SDI signal.

10. The signal processing apparatus according to claim 1, wherein in the case where predetermined payload information corresponding to this signal processing apparatus is not acquired by the acquiring unit, and the predetermined change has occurred to the signal type determined by the signal type determining unit, the payload information determining unit determines predetermined payload information as the payload information used for the display setting.

11. The signal processing apparatus according to claim 1, further comprising a recording unit configured to record, in a case where predetermined payload information corresponding to this signal processing apparatus is acquired by the acquiring unit, the acquired payload information in the storing unit in association with the signal type determined by the signal type determining unit, wherein in a case where the predetermined payload information is not acquired by the acquiring unit and the predetermined change has occurred to the signal type determined by the signal type determining unit, the payload information determining unit determines the payload information, which is recorded in the storing unit in association with a signal type that is the same as the signal type determined by the signal type determining unit, as the payload information used for the display setting.

12. A non-transitory computer readable medium that stores a program, wherein the program causes a computer to execute a control method of a signal processing apparatus, the control method comprising:

a signal type determining step of determining a signal type of an SDI (Serial Digital Interface) signal that is input to the signal processing apparatus;

an acquiring step of acquiring payload information from the SDI signal; and a payload information determining step of determining payload information that is used for display setting of the SDI signal, based on a state of acquiring the payload information in the acquiring step, wherein, in a case where predetermined payload information corresponding to this signal processing apparatus is not acquired in the acquiring step, and a predetermined change has not occurred to the signal type determined in the signal type determining step, in the payload information determining step, previously determined payload information is continuously used as the payload information used for the display setting.

13. A control method of a signal processing apparatus, comprising:

a signal type determining step of determining a signal type of an SDI (Serial Digital Interface) signal that is input to the signal processing apparatus;

an acquiring step of acquiring payload information from the SDI signal; and a payload information determining step of determining payload information that is used for display setting of the SDI signal, based on a state of acquiring the payload information in the acquiring step, wherein, in a case where predetermined payload information corresponding to this signal processing apparatus is not acquired in the acquiring step, and a predetermined change has not occurred to the signal type determined in the signal type determining step, in the payload information determining step, previously determined payload information is continuously used as the payload information used for the display setting.

* * * * *